US005458521A

United States Patent [19]

Todd

[11] Patent Number: 5,458,521

[45] Date of Patent: Oct. 17, 1995

[54] COMBINATION STORAGE CONTAINER AND EDUCATIONAL TOY

[75] Inventor: Robert S. Todd, Westwood, N.J.

[73] Assignee: Union Camp Corporation, Wayne, N.J.

[21] Appl. No.: 266,845

[22] Filed: Jul. 5, 1994

[51] Int. Cl.[6] ..... A63H 33/16; A63H 3/08; B65D 5/00

[52] U.S. Cl. ..... 446/73; 446/77; 446/388; 446/488; 446/80; 229/116.3; 229/116.4

[58] Field of Search ..... 446/73, 75, 77–80, 446/93–95, 99, 321, 388, 488, 230, 231; 229/8, 103, 116.1, 116.3, 116.4

[56] References Cited

U.S. PATENT DOCUMENTS

| | | | |
|---|---|---|---|
| D. 87,881 | 10/1932 | Lotto . | |
| D. 88,538 | 12/1932 | Hallward . | |
| D. 146,610 | 4/1947 | Mellick . | |
| D. 146,611 | 4/1947 | Mellick . | |
| D. 172,876 | 8/1954 | Goldman et al. . | |
| D. 174,121 | 3/1955 | Goldman et al. . | |
| D. 191,364 | 9/1961 | Schoendorf . | |
| D. 209,685 | 12/1967 | Jackson . | |
| D. 228,298 | 9/1973 | Moore . | |
| D. 252,543 | 8/1979 | Taylor . | |
| D. 252,718 | 8/1979 | Taylor . | |
| D. 252,778 | 9/1979 | Taylor . | |
| D. 254,439 | 3/1980 | Nottingham et al. . | |
| D. 256,868 | 9/1980 | Ogawa . | |
| D. 282,032 | 1/1986 | Lemmeyer . | |
| D. 296,853 | 7/1988 | Slater . | |
| D. 321,294 | 11/1991 | Ross . | |
| 728,386 | 5/1903 | Finne, Jr. | 446/77 |
| 1,330,780 | 2/1920 | Bonte | 446/76 X |
| 1,485,144 | 2/1924 | Morgan | 446/80 X |
| 1,866,493 | 7/1932 | Staats | 446/79 X |
| 1,932,368 | 10/1933 | Bowman | 446/78 |
| 2,180,653 | 11/1939 | Yancey et al. . | |
| 2,232,953 | 2/1941 | Mallgraf . | |
| 3,261,619 | 7/1966 | Norgaard et al. | 446/488 X |
| 3,400,485 | 9/1968 | Callin et al. . | |
| 3,777,392 | 12/1973 | Span et al. | 446/78 |
| 4,131,227 | 12/1978 | Patton et al. | 446/80 X |
| 4,132,345 | 1/1979 | Nielsen . | |
| 4,200,197 | 4/1980 | Meyer et al. | 446/73 X |
| 4,206,567 | 6/1980 | Cieslak | 446/73 |
| 4,527,688 | 7/1985 | Jones et al. . | |
| 4,736,847 | 4/1988 | Wang . | |
| 4,781,643 | 11/1988 | Holloway et al. | 446/75 |
| 4,963,115 | 10/1990 | Davin et al. | 446/75 X |

*Primary Examiner*—Mickey Yu
*Attorney, Agent, or Firm*—Dennis H. Lambert

[57] ABSTRACT

A storage container for use in a child's room to store toys or other items, wherein the container includes removable components that may be assembled to and removed from the container to form different objects, such as vehicles, animals, and the like, thereby making the container, itself, an entertaining and educational toy. At least some of the components of the combined storage chest and toy may be used interchangeably to make a plurality of different objects, thereby minimizing the number of pieces that must be manufactured to form a plurality of different objects.

15 Claims, 10 Drawing Sheets

COMBINATION STORAGE CONTAINER AND EDUCATIONAL TOY

FIELD OF THE INVENTION

This invention relates generally to storage containers. More particularly, the invention relates to a combined storage container and toy for use in a child's room to store toys and the like, and includes interchangeable components which may be assembled together to form a variety of different entertaining and educational objects.

BACKGROUND OF THE INVENTION

Most small children have a large variety and number of toys with which they can play for entertainment and/or educational purposes. These toys are typically kept in the child's room, and are usually put away in a toy chest when the child is through playing with them. Conventional toy chests generally comprise nothing more than a box or receptacle with an open top that may or may not have a lid. Such conventional toy chests usually do not conform to the decor of the child's room and may even be unsightly if left on display in the room. Consequently, many parents place the toy chest in a closet or the like where it remains out of sight. Moreover, most parents can attest to the difficulty of persuading their child or children to put their toys away when they are through playing with them.

Conventional toy chests as described above do not have any value as a toy nor do they provide any educational benefit to the child.

Thus, there is need for a storage container or chest for storing toys and the like, which is also capable of functioning, itself, as an entertaining and educational toy. By selecting appropriate graphics and accessory components, the combined storage chest and toy can be made to fit the decor of almost any child's room. The toy chest of the invention comprises a fun, interesting and educational addition to the room, and can induce the child to put toys away without undue coaxing from the parent.

SUMMARY OF THE INVENTION

In accordance with the present invention, a combination child's storage chest and toy is provided. The invention thus serves not only as a means for storing toys and the like, but also comprises a fun and educational toy which can inform and educate the child about a variety of items. The combined storage chest and toy of the invention is made from corrugated cardboard, although it may be made from any suitable material, including paperboard or fiberboard, plastic, wood, or metal.

In a preferred construction, the combined storage chest and toy of the invention is made from corrugated cardboard. A relatively small number of die-cut pieces may be used with different graphics in order to create a large variety of objects. For instance, by appropriate design of the accessory pieces or components, they may be interchangeable among a plurality of different objects to form any one of a plurality of different objects, including vehicles, i.e, space shuttle, tractor trailer, bulldozer, school bus, etc. Alternatively, by selection of other graphics and choice of appropriate accessory components the invention could be adapted to form any one of a variety of rare and/or endangered animals, such as tigers, Indian elephants, black rhinos, leopards, etc. Other themes may equally as well be incorporated in the invention, such as armadillos, turtles, dinosaurs, sharks, whales and the like.

An important part of the present invention is the interchangeability of at least some of the components among a plurality of different objects. This enables manufacture of the container and accessory components in a relatively small number of die-cut pieces that are interchangeable among a plurality of different thematic structures that can be produced with the components, thereby minimizing the cost to manufacture the invention. If desired, different graphics can be provided on appliques which a child could apply to the basic container and accessories to convert it into a toy chest having different themes.

The combined storage chest and toy of the invention is functional and sturdy, is easy to assemble without the use of tools, and it may be disassembled for storage. Non-toxic inks are employed in the graphics, and there are no sharp edges which might injure the child during use.

The combined storage chest and toy of the invention is both fun and educational and may include descriptive material relating to interesting facts about the various themes that may be created with the invention. Additionally, the toy box of the invention is recyclable and makes putting toys away fun.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein.

DETAILED DESCRIPTION OF THE PREFERRED EMBODIMENTS

Figure 1:
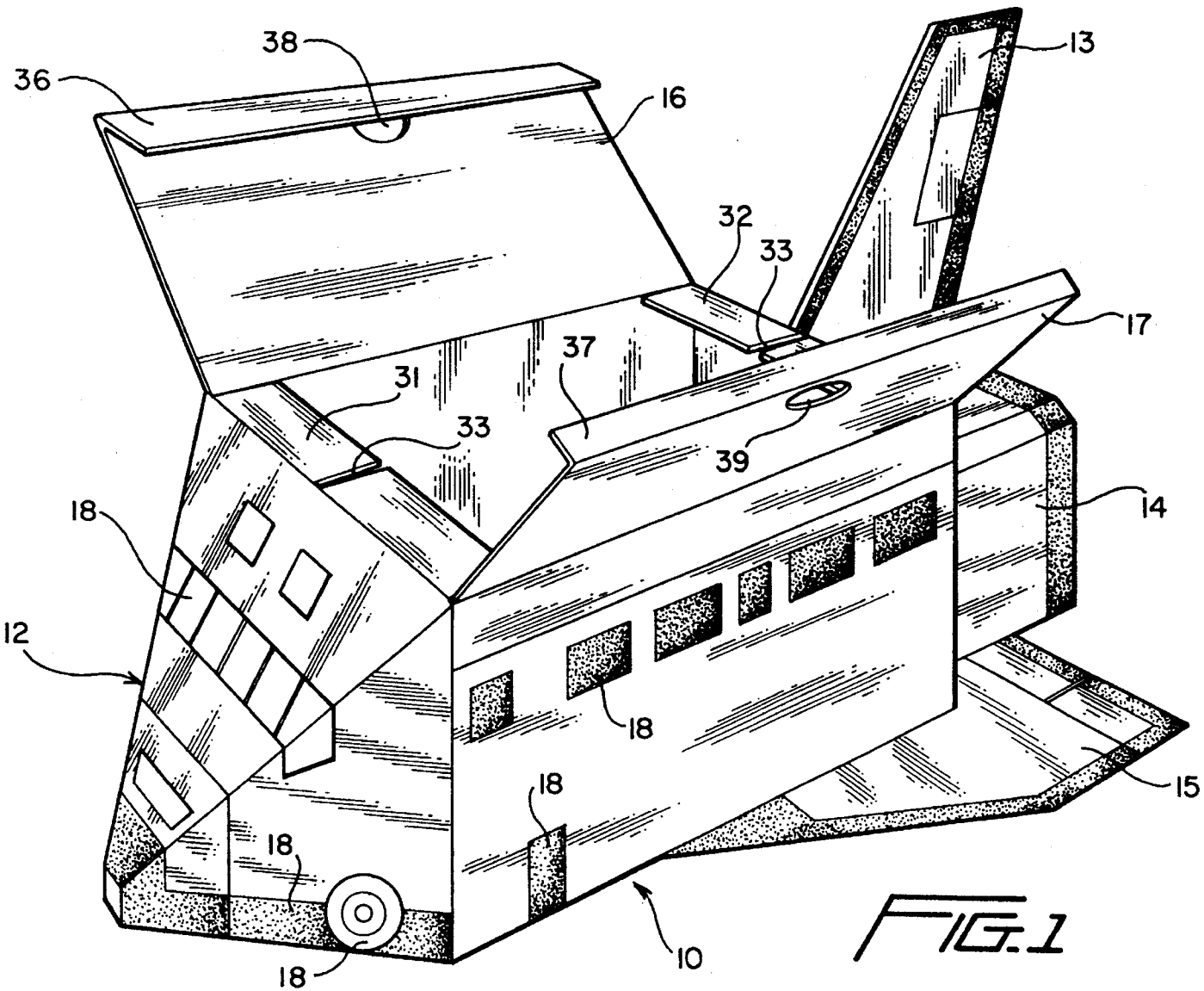
FIG. 1 is a top perspective view of a first form of combined storage chest and toy in accordance with the invention, wherein a space shuttle is depicted, with the lid of the storage box shown open and representing the doors to the cargo bay of the space shuttle.

Referring more specifically to the drawings, a first form of the invention is indicated generally at 10 in FIGS. 1–9. This form of the invention depicts the space shuttle, and comprises only four die-cut pieces or components, including the rectangularly shaped box that forms the main fuselage or cargo bay section 11, tapered nose section 12, stabilizer 13, engine pod 14, and wing 15. The nose section, engine pod and wing are all removably assembled to the box section by interfitting tabs and slots. Openable panels 16 and 17 form a lid for the box and correspond to the bay doors of the shuttle. Suitable graphics 16 are applied to the box and accessory pieces to enhance the space shuttle appearance.

Figure 6:
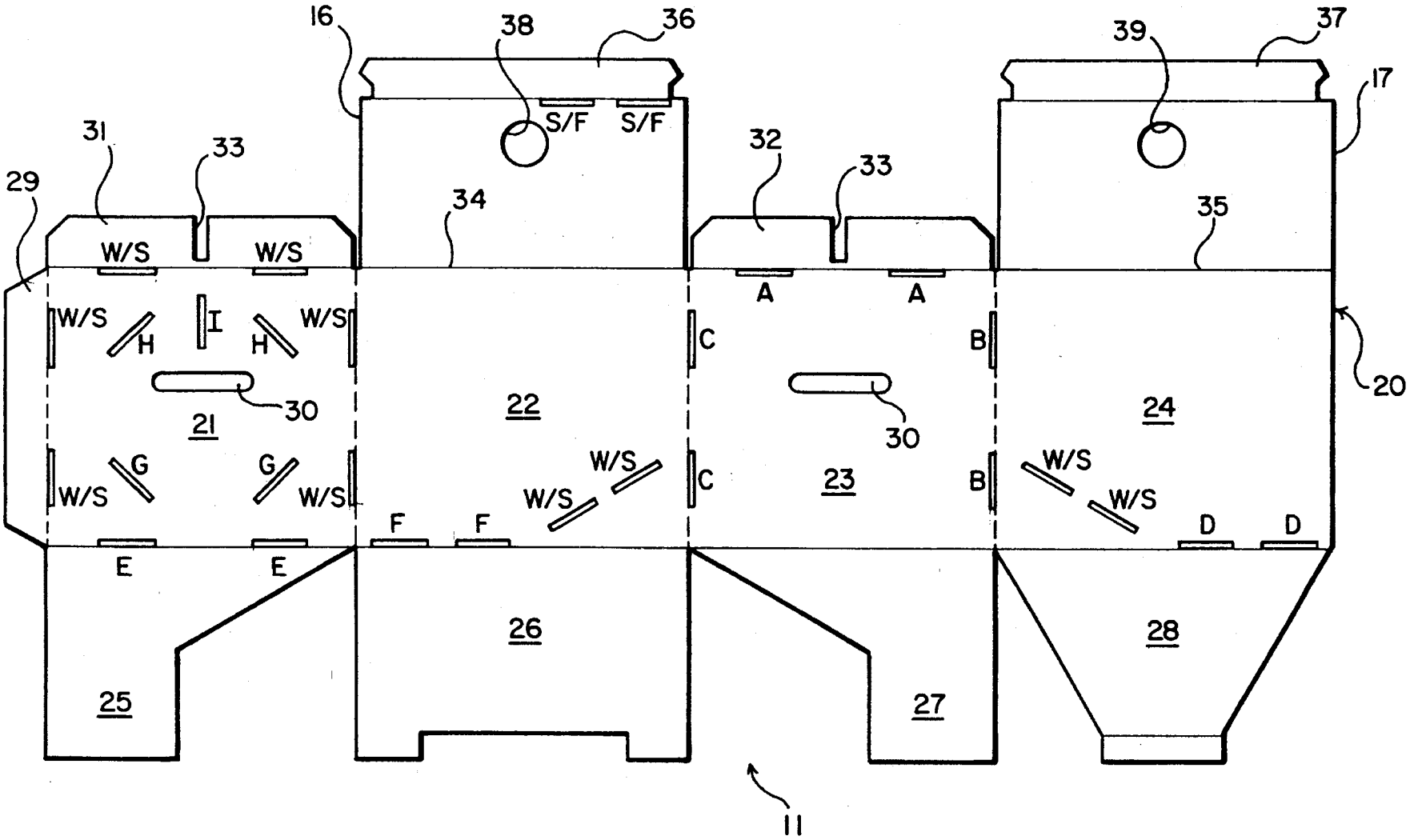
FIG. 6 is a top plan view of the blank used to make the main body or box of the device of FIG. 1.

Referring to FIG. 6, the box or main fuselage section 11 comprises a single blank or die-cut piece 20 having first, second, third and fourth rectangularly shaped panels 21, 22, 23 and 24 that form the side and end walls of the assembled box. Shaped flaps 25, 26, 27, and 28 project integrally from the bottom edges of the rectangular panels, and form the bottom of the box when the blank is folded into its assembled position. A relatively narrow tab or flap 29 projects integrally from the end of panel 21 and is suitably affixed as by gluing or the like to a corresponding edge portion at the free edge of panel 24 when the toy box is assembled.

As seen best in FIG. 6, the panels 21 and 23 are slightly narrower in longitudinal dimension than the panels 22 and 24, and comprise the end panels in the assembled box. Each of these panels has an elongate slot 30 defining an opening which may be used as a hand grip to carry the box when desired. Additionally, relatively narrow flaps 31 and 32 project integrally from the upper edges of these end wall panels and are transversely slotted at 33 intermediate their opposite ends.

Figure 2:
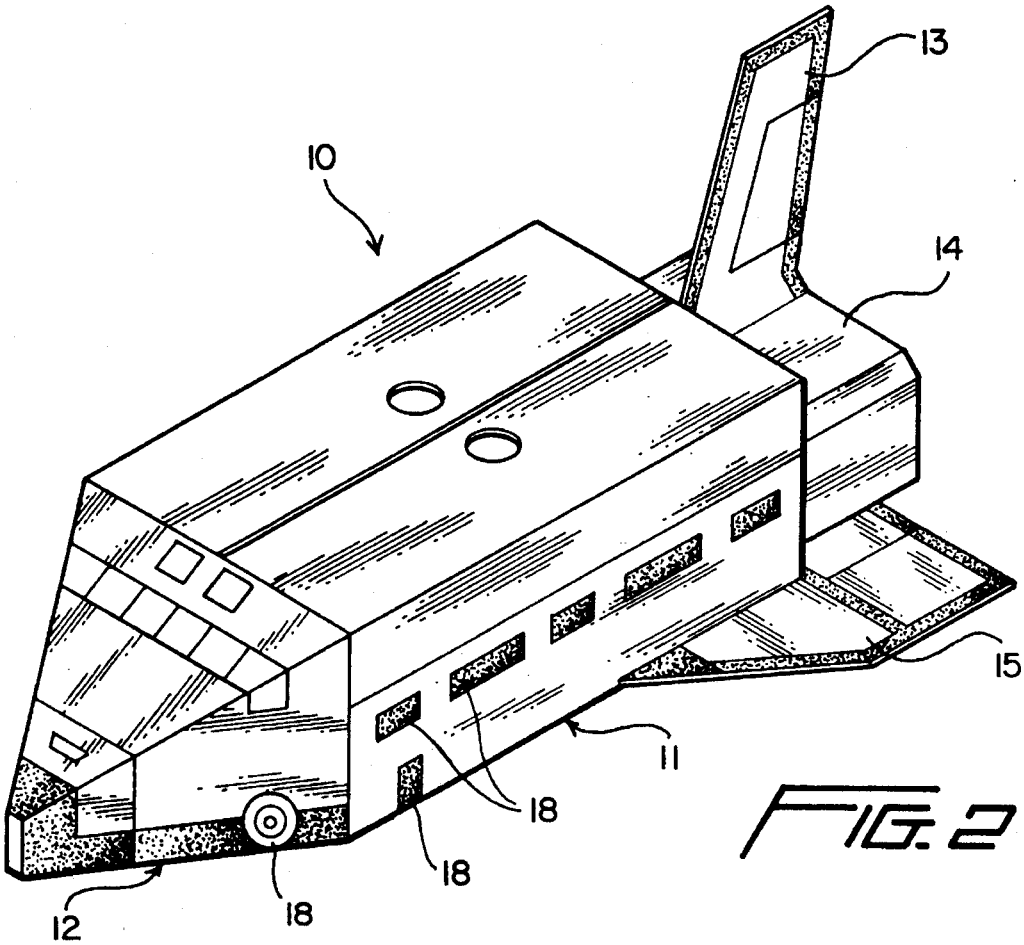
FIG. 2 is a top perspective view of the device of FIG. 1, with the lid in closed position.
Figure 3:
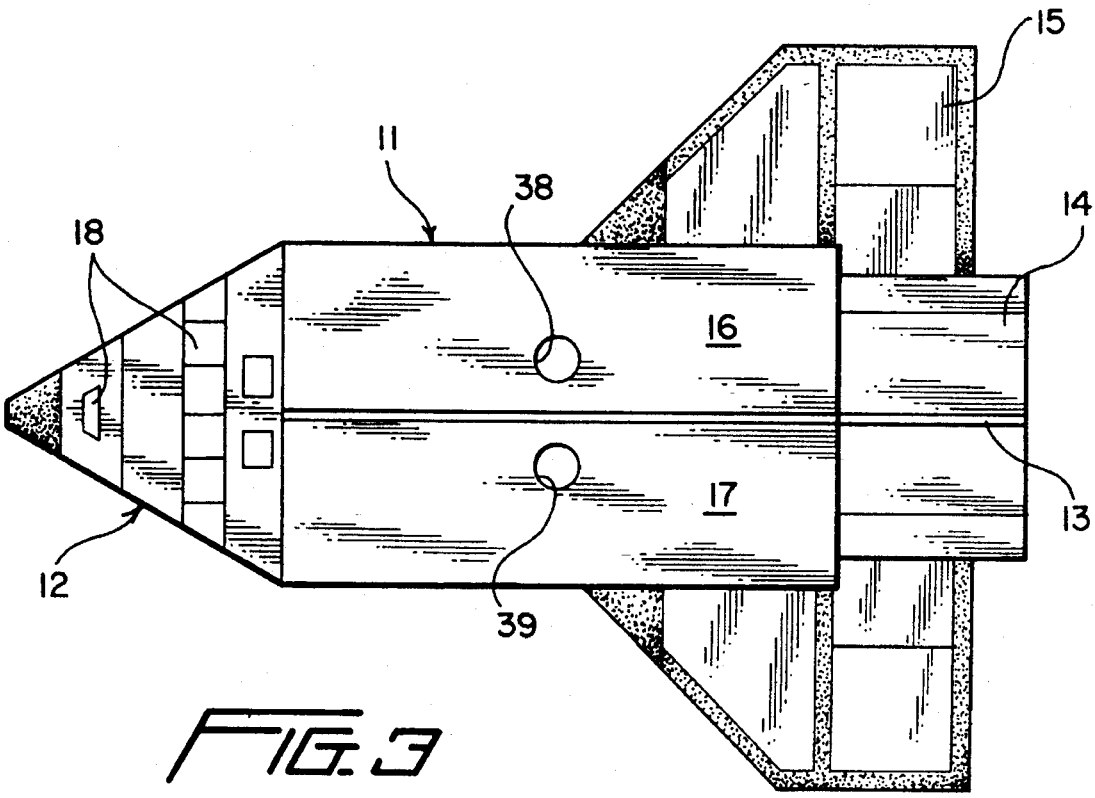
FIG. 3 is a top plan view of the device of FIG. 2.
Figure 4:
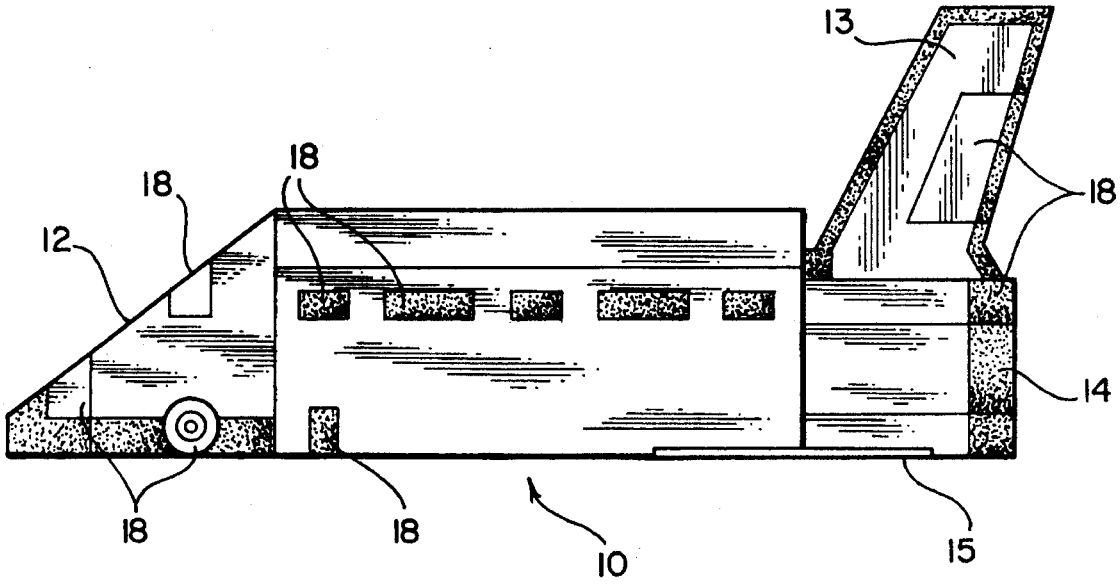
FIG. 4 is a side view in elevation of the device of FIG. 2.

The lid closure members 16 and 17 extend integrally from the upper edges of panels 22 and 24, respectively, and are movable between opened and closed positions about fold lines 34 and 35, respectively. Each of the lid members 16 and 17 extends approximately half way across the width of the assembled box and meet in the middle when in their closed position as shown in FIGS. 2 and 3. Relatively narrow tabs 36 and 37 extend integrally from the free edges of the closure members 16 and 17 and are adapted to extend into the slots 33 of flaps 31 and 32 when the lid members are closed. Openings 38 and 39 are formed through the lid members approximately midway between their opposite ends and adjacent the outer free edges thereof to serve as hand grips to facilitate opening the lid members.

Figure 5:
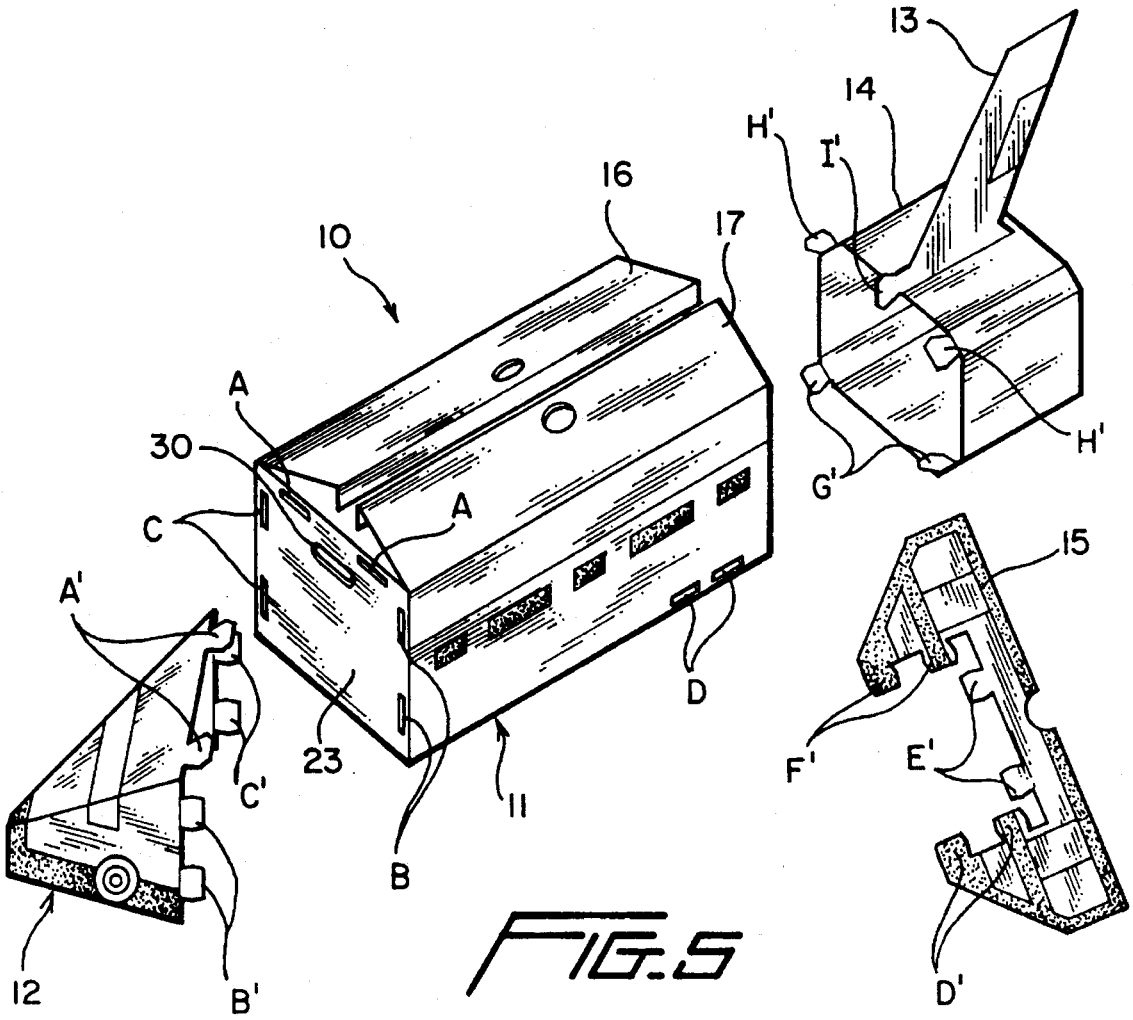
FIG. 5 is an exploded top perspective view of the device of FIG. 2, with the individual accessory pieces or components shown removed from the box.

As seen best in FIGS. 5 and 6, end panel 23 has a first pair of spaced apart slots A formed therethrough at the upper edge thereof, and second and third spaced apart pairs of slots B and C formed therethrough at the opposite side edges thereof.

Figure 8:
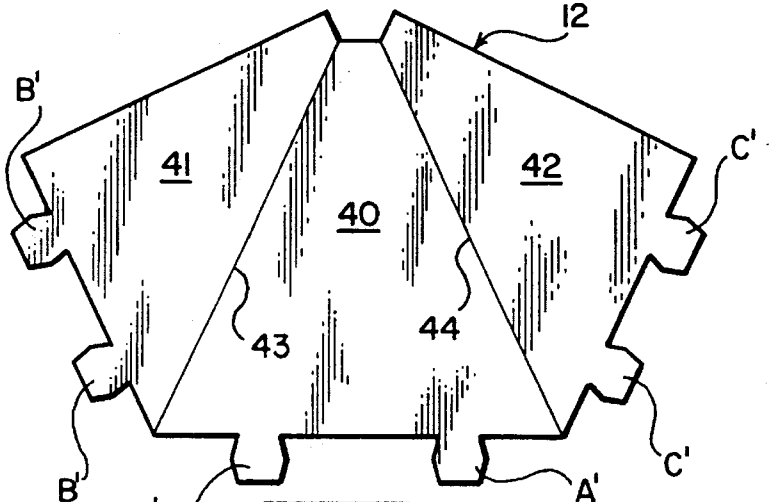
FIG. 8 is a top plan view of the blank or die-cut piece used to form the nose section of the device of FIG. 1.

As seen best in FIGS. 5 and 8, nose section 12 comprises a first generally triangularly shaped panel 40 with second and third generally triangularly shaped panels 41 and 42 joined to opposite sides thereof along fold lines 43 and 44, respectively. Pairs of tabs A', B' and C' are formed on the respective panels for insertion into the slots A, B, and C, respectively, in end wall panel 23 to attach the nose section 12 to the center box section 11.

Similarly, opposite end panel 21 has a plurality of diagonally extended slots H and G formed therethrough for receipt of corresponding tabs H' and G', respectively, on the engine pod 14, and a further, vertically oriented slot I formed therethrough approximately midway between the opposite side edges and spaced downwardly from the upper edge, for receipt of a corresponding tab I' on the stabilizer section 13 to hold the tail section, including the engine pod 14 and stabilizer 13, to the box.

Figure 7:
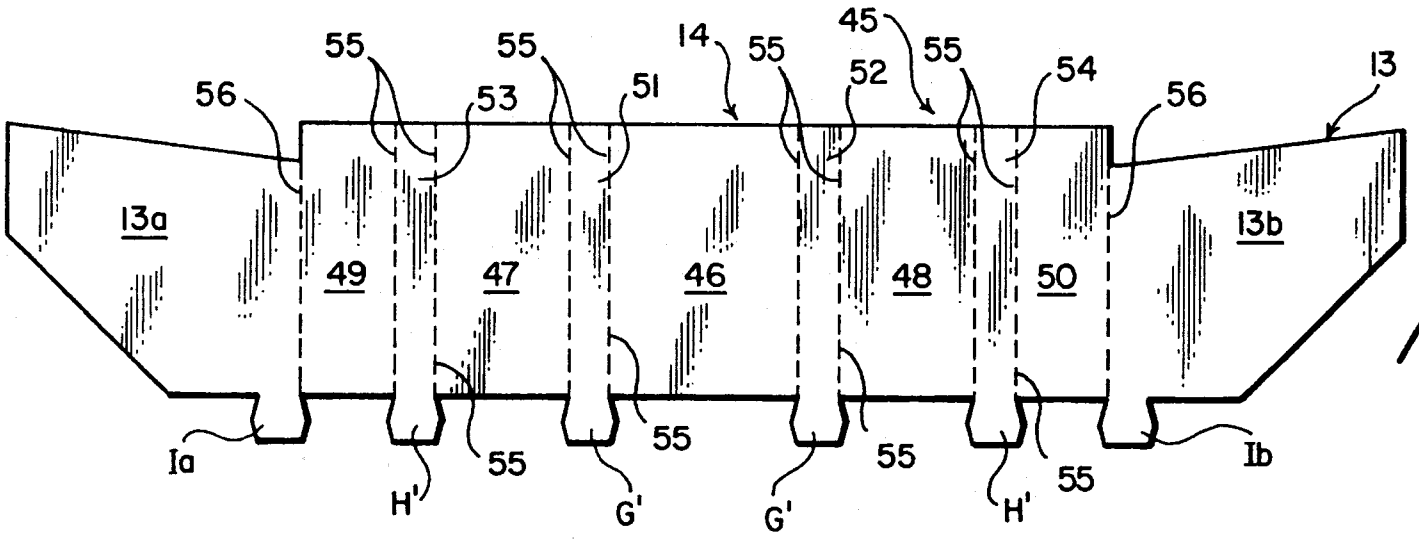
FIG. 7 is a top plan view of the blank or die-cut piece used to form the stabilizer and engine pod of the device of FIG. 1.

With reference to FIGS. 5 and 7, the stabilizer and engine pod are made from a single blank 45 formed with mirror image mating halves **13*a* and 13*b* on opposite ends of the blank and which form the stabilizer 13 when they are brought together. Between the stabilizer halves, the blank is divided into a plurality of rectangularly shaped panels 46 through 50, separated from one another by relatively narrow, rectangularly shaped panels 51 through 54, defined by fold lines 55. The stabilizer sections 13*a* and 13*b* are similarly joined to the outer-most panels 49 and 50 by fold lines 56. Tabs G' and H' extend from one end of the narrow panels 51 through 54, and tabs Ia and Ib extend from the base end of the stabilizer sections 13*a* and 13*b*, respectively. Thus, when the engine pod and stabilizer blank is folded about the fold lines, the stabilizer halves or sections 13*a* and 13*b* come into mating contact with one another as seen in FIG. 5 and the tabs H', G', Ia and Ib are inserted into the corresponding slots G, H and I in the end wall panel 21**.

Figure 9:
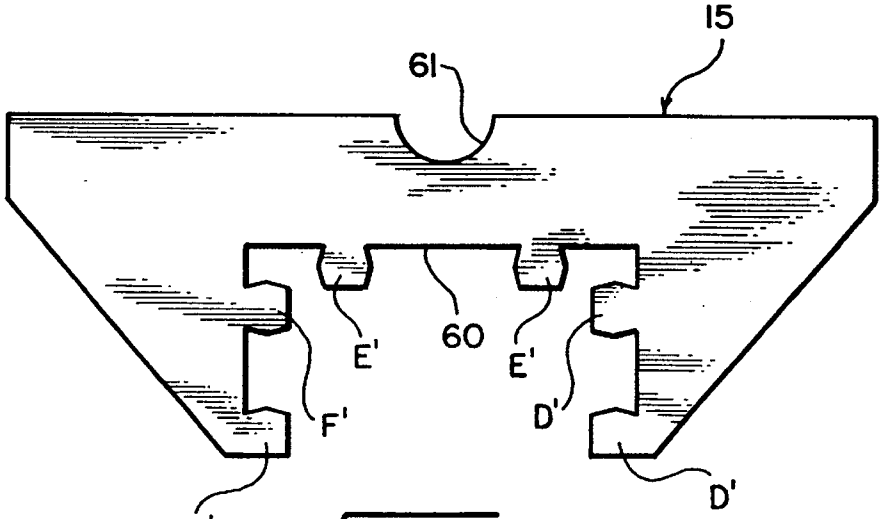
FIG. 9 is a top plan view of the blank or die-cut piece used to form the wing of the device of FIG. 1.

With reference to FIGS. 5 and 9, wing 15 is also formed form a single blank having a cut-out 60 in its forward or leading edge to receive the end of box 11. Pairs of tabs D' and F' project inwardly from the wing sections at opposite sides of the cut-out for receipt in the corresponding slots D and F formed through the side panels 24 and 22 of box 11, and forwardly projecting tabs E' extend into the corresponding slots E at the bottom of end panel 21 to hold the wing section 15 to the box. A semi-circular notch 61 is formed in the rear or trailing edge of wing section 15 for a purpose to be later described.

FIRST MODIFICATION

Figure 10:
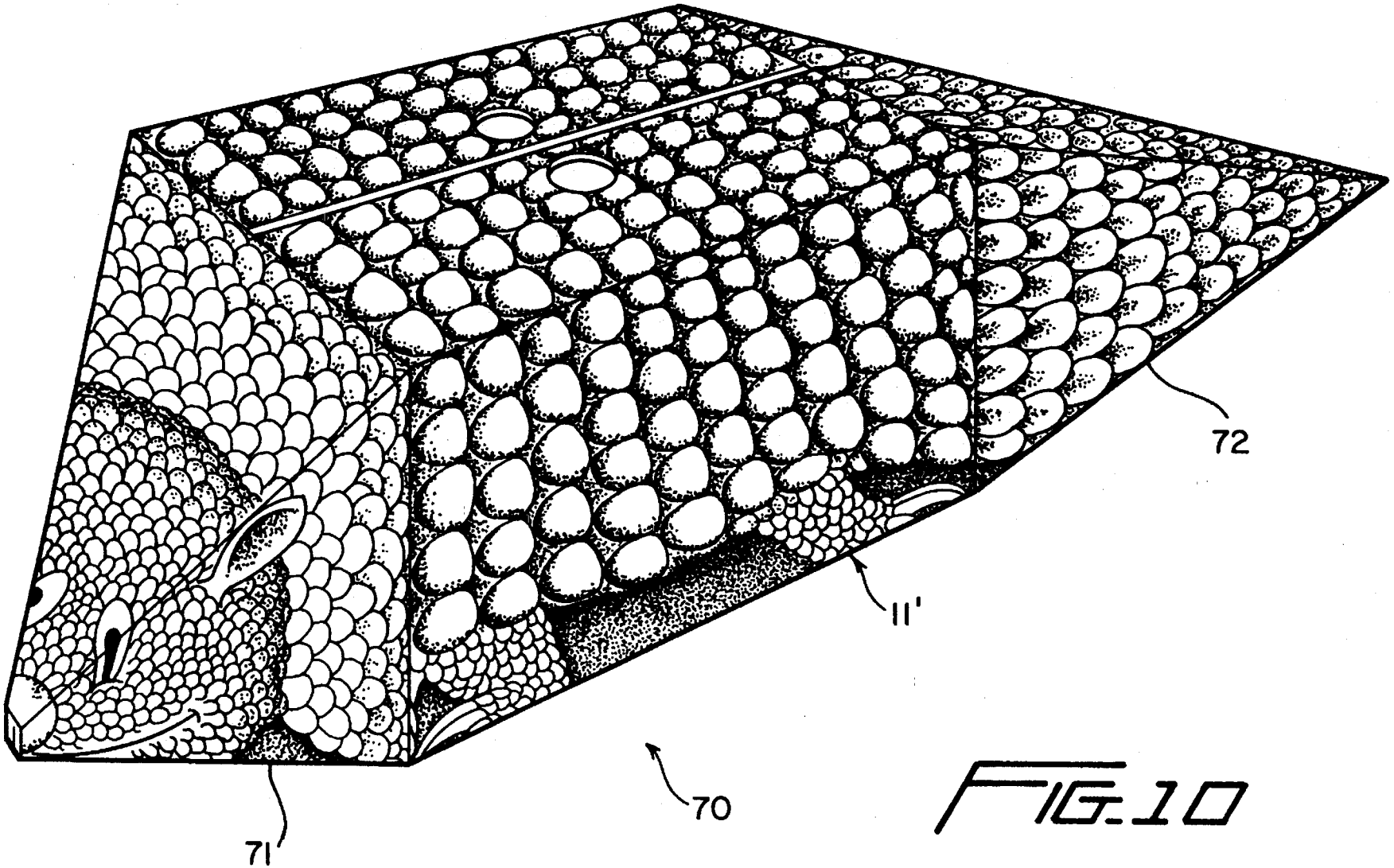
FIG. 10 is top perspective view of a further form of storage box and toy according to the invention, wherein an armadillo is depicted, and in which, with different graphics, the same die-cut piece as used for the nose of the shuttle in FIG. 1 may be used for the head of the armadillo in this figure.

A first modification of the invention is indicated generally at 70 in FIG. 10, wherein a nose section 71 and tail section 72 are assembled to opposite ends of box 11', with suitable graphics applied to represent an armadillo. With the exception of the graphics, the nose section 71 is made from the same blank as used to form the nose section 12 of the space shuttle depicted in FIG. 1. Similarly, and with the exception of the graphics, the box section 11' is made from the same blank as used to form the box section 11 of the space shuttle.

Figure 11:
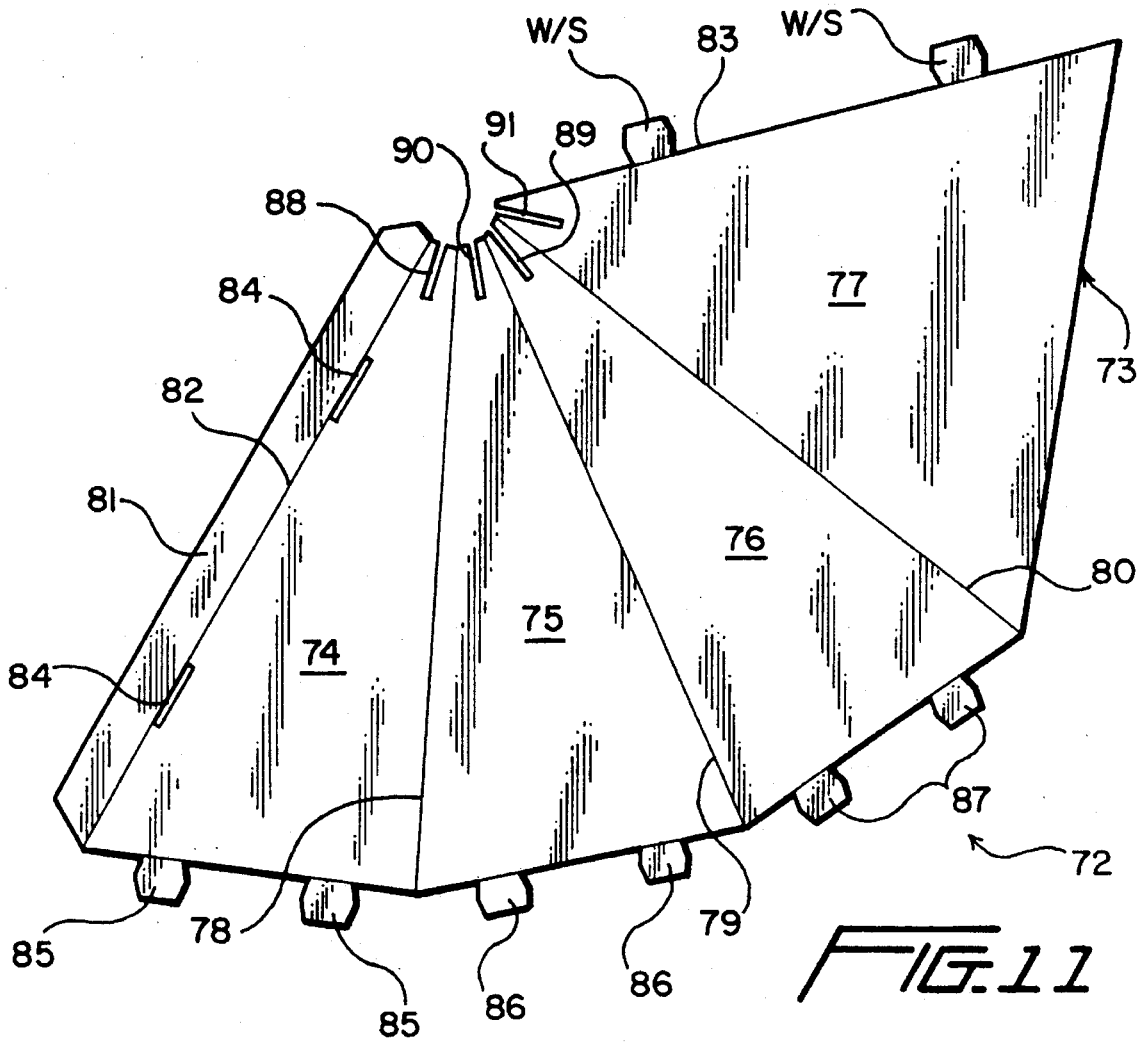
FIG. 11 is a top plan view of the blank or die-cut piece used for the tail of the armadillo in FIG. 10.
Figure 17:
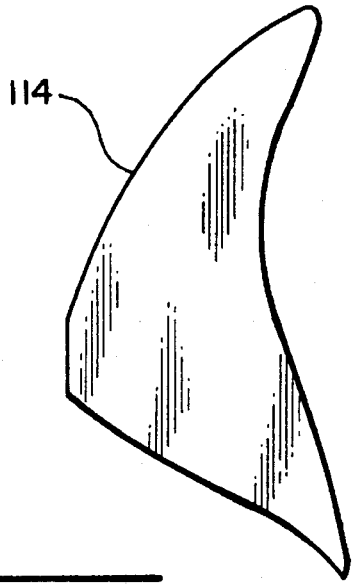
FIG. 17 is a top plan view of yet another form of the invention, wherein an elephant is depicted, and in which the same die-cut piece used for the wing of the shuttle in FIG. 1 is used for the ears of the elephant.

Tail section 72, on the other hand, is made from an additional blank 73 as shown in FIG. 11. Blank 73 is made to define four triangularly shaped panels 74, 75, 76 and 77, joined together along their adjacent side edges by fold lines 78, 79, and 80. A relatively narrow tab 81 is joined to the outer edge of panel 74 along fold line 82. It should be noted that this outer edge of panel 74 is the same length as edge 83 of panel 77, whereby when the blank is folded about the fold lines to form the tail 72, the flap 81 extends beneath the adjacent edge of panel 77, and tabs w/s on edge 83 extend into slots 84 in the edge of panel 74 to hold the blank in assembled relationship. It should be noted that edges 78 and 79 have the same length, but are shorter than edge 80, which, in turn, is the same length as edges 82 and 83. Accordingly, panels 75 and 77 are shaped essentially as isosceles triangles while panels 74 and 77 are shaped as scalene triangles.

Pairs of tabs 85 and 87 on the ends of panels 74 and 76 engage in slots w/s at opposite side edges of end panel 21 in section 11', while tabs 86 on the end of panel 75 engage in slots E in the end panel 21 to hold the tail assembled to the box.

Further, slots 88 and 89 are formed in the small ends of panels 74 and 76, while slots 90 and 91 are formed in the small ends of panels 75 and 77, for a purpose to be described later.

SECOND MODIFICATION

Figure 12:
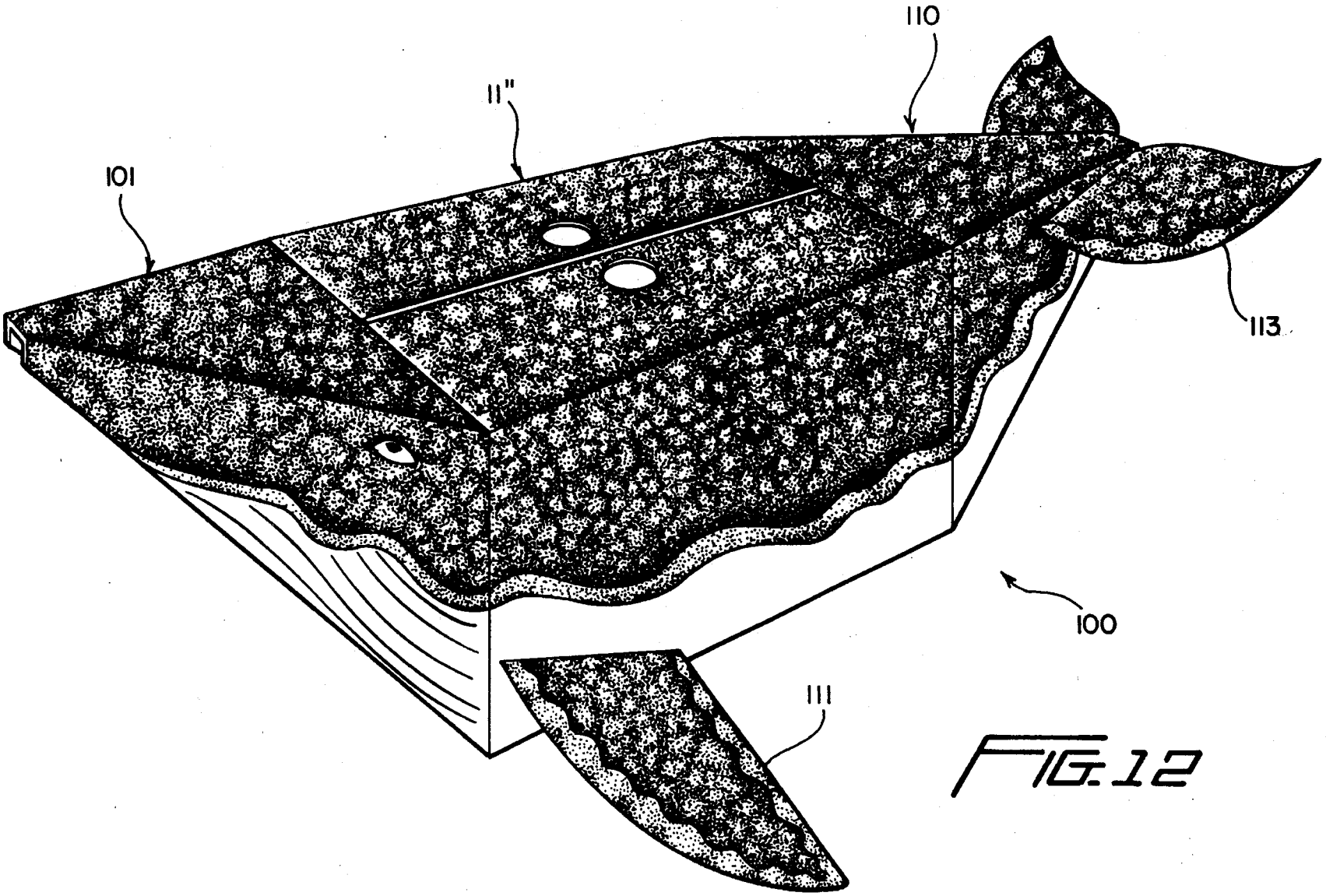
FIG. 12 is a top perspective view of another form of the invention, wherein a whale is depicted by the assembled components, and wherein the same die-cut piece used for the tail of the armadillo can be inverted or turned upside down and used as the tail of the whale, with different graphics applied.
Figure 16:
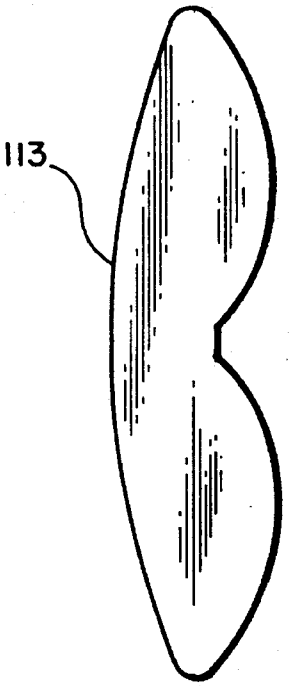
FIG. 16 is a top plan view of the die-cut pieces used for the tail or flukes of the whale.
Figure 15:
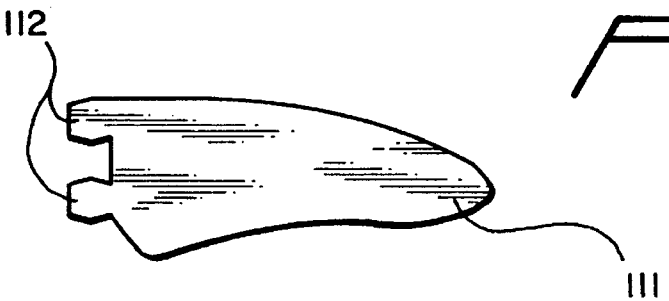
FIGS. 14 and 15 are top plan views of the die-cut pieces used for the flippers of the whale in FIG. 12.
Figure 14:
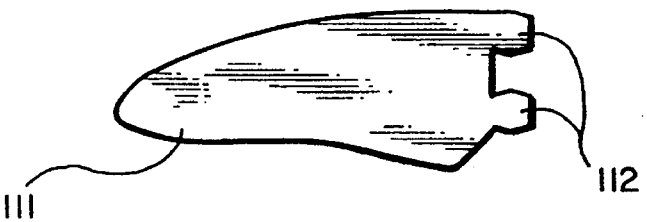

A second modification is indicated generally at 100 in FIG. 12. In this form of the invention, the body or box portion 11" comprises the same blank or die-cut piece as the box 11 used in the space shuttle and the box 11' used in the armadillo, although different graphics are applied to depict a whale. Moreover, the nose 101 of the whale is made from an additional blank or die-cut piece 102, having a slightly elongated dimension relative to the nose 12 used on the space shuttle and the armadillo, although the same nose piece could be used for the whale, if desired. Further, whereas the nose piece slopes downwardly in both the space shuttle and armadillo, it thrusts upwardly in the whale. Accordingly, if the same die-cut piece were to be used for all of these nose sections, it would be necessary to turn the piece upside down when used in forming the whale.

Figure 13:
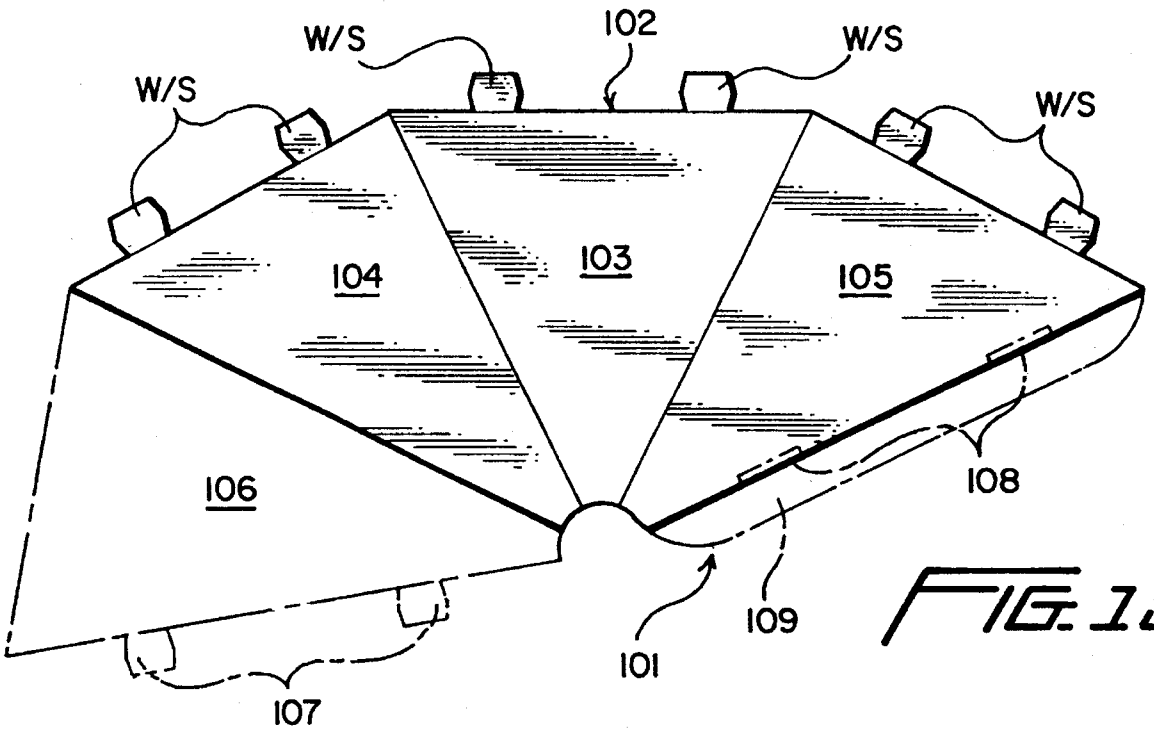
FIG. 13 is a top plan view of the blank or die-cut piece used to form the head of the whale in FIG. 12.

The elongated blank 102 used to form the nose piece 101 of the whale is cut so that a center panel 103 forms an isosceles triangle and functions as the top of the whale's head, while two scalene triangles at each side of the panel 103 form side panels 104 and 105 that define the sides of the whale's head. If desired, a fourth panel 106 could be provided as indicated in dot-and-dash lines in FIG. 13 so that all four sides of the whale's head are enclosed. Tabs 107 on the free edge of panel 106 could be provided for insertion into slots 108 in the free edge of panel 105, and a narrow flap 109 on panel 105 could be provided to hold the nose in assembled relationship. If a fully closed head section is desired, the same blank could be used as is used for the tail of the armadillo, rather than to provide a new blank or die-cut piece having essentially the same construction. It should be noted however, that the die-cut piece forming the head of the whale is somewhat shorter than the die-cut piece that forms the tail for the armadillo or the whale.

In this last connection, the tail 110 of the whale comprises the same die-cut piece as used for the tail of the armadillo, although different graphics are applied and the piece is turned upside down so that it thrusts upwardly as seen in FIG. 12.

The pairs of tabs 85, 86 and 87 (see FIG. 11) are inserted into the slots w/s at the opposite side edges and top edge of panel 21 when the blank 73 is used for the tail of the whale as shown in FIG. 12.

Tabs w/s on the ends of panels 103, 104 and 105 engage in the slots A, B and C at the opposite side edges and top edge of end panel 23 to hold the nose assembled to the body 11' of the whale as shown in FIG. 12.

Flippers 111 have tabs 112 on their base end for engagement in the diagonally extending slots w/s near the front of the side panels 22 and 24, and a tail fluke 113 is inserted into the slots 88 and 89 of panels 74 and 76 (see FIG. 11).

THIRD MODIFICATION

Figure 18:
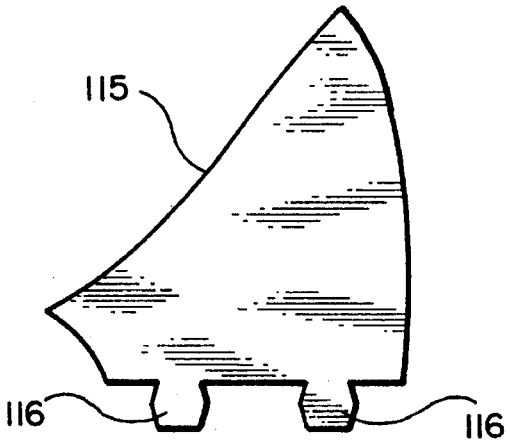
FIG. 18 is a side view in elevation of the die-cut piece used for the dorsal fin of a shark that may be formed with the invention.
Figure 19:
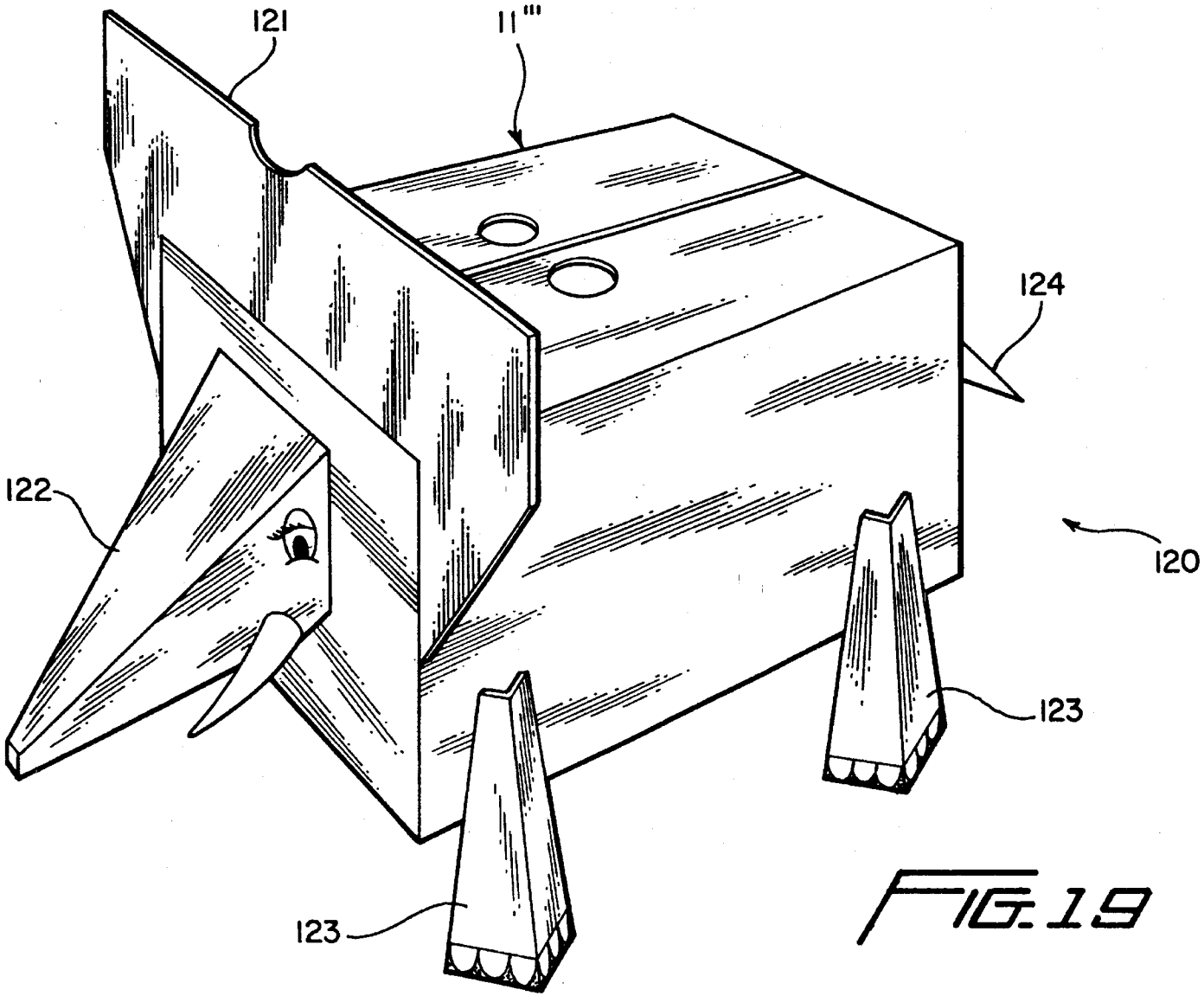
FIG. 19 is a side view in elevation of the die-cut piece that may be used for the tail of the shark.

Another variation of the invention may be constructed to depict a shark (not shown) by using all the same die-cut pieces shown in FIG. 12 to make the whale, with the exception of the tail 113, which would be replaced with tail 114 as shown in FIG. 19, engaged in slots 90 and 91 of the tail piece so that it stands vertically. Additionally, a dorsal fin 115, having tabs 116 as shown in FIG. 18, would be assembled to the top of the box by engaging the tabs 116 through the slots S/F in lid portion 16 (see FIG. 6).

FOURTH MODIFICATION

A fourth modification of the invention is depicted at 120 in FIG. 19. In this form of the invention, suitable graphics and die-cut pieces are provided to depict an elephant. The body 11'" of the elephant comprises the same die-cut piece as used in constructing the main body of each previously described form of the invention, and the ears 121 of the elephant comprise the same die-cut piece as used for the wing of the space shuttle. When constructing the elephant, the tabs E' on the blank used for the wing are engaged in the slots A at the top edge of panel 23, and the tabs D and F at the opposite sides of the cut-out in the blank are engaged in slots B and C at opposite side edges of panel 23 (see FIG. 6). Additional die-cut pieces (not shown) would have to be provided to form the trunk 122, legs 123 and tail 124 of the elephant.

It should therefore be apparent that by using interchangeable die-cut pieces, a variety of different figures can be created. For instance, a turtle could be provided in which the elephant's legs become the turtle's legs, and the elephant's trunk becomes the turtle's tail.

If desired, the combined storage box and toy of the invention could be provided in kit form, with a variety of die-cut pieces and graphic appliques which could be applied by the child, as desired, to create a variety of interesting and educational figures. The invention thus comprises a toy in itself as well as offering storage for small items in a child's room. With a small number of die-cut pieces, various objects can be created with exciting two color or multi-color graphics, and would be a fun, interesting and educational addition to any child's room.

While a particular embodiment of the invention has been illustrated and described in detail herein, it should be understood that various changes and modifications may be made to the invention without departing from the spirit and intent of the invention as defined by the scope of the appended claims.

What is claimed is:

1. A combination storage container and toy with interchangeable components for forming a plurality of objects using at least some of the same components to form different objects, wherein:

said components include a main body portion formed from a first blank of paper material folded to have top, bottom, and opposite side and end walls defining a hollow interior for receipt and storage of items, and a plurality of different accessory components for assembly to said main body portion to form a selected one of the plurality of objects;

said main body portion has a plurality of preformed slots therein, and the accessory components have tabs thereon for receipt in the slots, whereby at least one of the accessory components may be assembled to the main body portion in different orientations and positions, depending upon which tabs are inserted into which slots, to form different objects;

said accessory components are assembled to said main body portion by engagement of the tabs into selected ones of the preformed slots to form said selected object, and are movable to different predetermined arrangements by inserting the tabs into different ones of the preformed slots to form a different object;

graphics are applied to said main body portion and said accessory components to visually represent the selected object; and said main body portion and at least one of said accessory components are constructed so that they are interchangeable among different objects, whereby a plurality of objects can be formed from a minimum number of manufactured components.

2. The combination as claimed in claim 1, wherein:

said main body portion is interchangeable among all objects formed with the components.

3. The combination as claimed in claim 2, wherein:

the selected object comprises a whale, with the main body portion comprising the main body of the whale, and the accessory components including the head and tail of the whale, assembled, respectively, to the opposite end walls.

4. The combination as claimed in claim 3, wherein:

the head and tail comprise die cut pieces that may have different graphics applied to them and assembled to the main body portion to form objects other than the whale.

5. The combination as claimed in claim 2, wherein:

said selected object comprises a vehicle representative of the space shuttle, with the main body portion comprising the main fuselage or cargo bay of the space shuttle, and the accessory components comprising a nose section forming a cabin assembled to one end wall of the main body portion, an engine pod and stabilizer assembled to the other end wall of the main body portion, and a wing assembled to said other end wall in a position below the engine pod, said accessory components each being formed from a blank of paper material.

6. The combination as claimed in claim 5, wherein:

the nose section comprises a single die cut piece that may have different graphics applied to it and assembled to the main body portion to form a different object than the space shuttle.

7. The combination as claimed in claim 6, wherein:

the wing comprises a single die cut piece that may have different graphics applied to it and assembled to the main body portion to form a different object than the space shuttle.

8. The combination as claimed in claims 2, wherein:

said selected object comprises an animal representative of an armadillo, with the main body portion comprising the body of the armadillo, and the accessory components comprising the head and tail of the armadillo, said head being assembled to one end wall and said tail being assembled to the other end wall.

9. The combination as claimed in claim 8, wherein:

said head comprises a single die cut piece that may have different graphics applied to it and assembled to the main body portion to form a different object than the armadillo.

10. The combination as claimed in claim 2, wherein:

said components comprise die cut pieces of corrugated cardboard.

11. The combination as claimed in claim 5, wherein:

said main body portion has an open top, and a movable panel is pivotally connected to a top edge of each of the opposite side walls of the main body portion to form a closable lid for the open top, said movable panels meeting along a longitudinal center line of the main body portion when the movable panels are in closed position, thereby simulating the cargo bay doors on a space shuttle.

12. The combination as claimed in claim 1, wherein:

the top and opposite side and end walls of the main body portion each have a plurality of slots therein for receiving tabs on the accessory components to secure the accessory components to the respective walls, at least one of said walls having a plurality of slots arranged in multiple groups or patterns so that an accessory component may be assembled thereto in different ways by inserting the tabs on that accessory component into selected groups of slots.

13. A combined storage chest and educational toy having a plurality of interchangeable components to form different simulated objects, comprising:

a main body portion having a top, bottom and opposite side and end walls defining a hollow interior for receiving and storing items, the top and opposite side and end walls of said body portion having a plurality of preformed slots therein arranged in different groupings or patterns; and a plurality of interchangeable accessory components assembled to the main body portion to form one of said simulated objects, said accessory components having tabs thereon which are inserted into selected ones of said slots in the main body portion to secure the accessory components to the main body portion in predetermined positions to form said one simulated object, and said tabs being insertable into different slots to differently orient said accessory components to form a different simulated object, whereby the same accessory components can be used with the main body portion to form different simulated objects, minimizing the number of parts which must be manufactured.

14. A combined storage chest and educational toy as claimed in claim 13, wherein:

the accessory components comprise two irregular pyramids each having a rectangular base, three triangular sides and an open side, all meeting at a common apex, the base of each pyramid being attached to a respective end wall of the main body portion and having the same dimensions as the end wall so that the base of the respective pyramids covers the end wall to which that pyramid is attached, and the open side lying in the same plane as the bottom wall of the main body portion, said main body portion and accessory components simulating an armadillo.

15. A combined storage chest and educational toy as claimed in claim 13, wherein:

the accessory components include two irregular pyramids each having a rectangular base and four triangular sides meeting at a common apex, the base of each pyramid being attached to a respective end wall of the main body portion and having the same dimensions as the end wall so that the base of the respective pyramids covers the end wall to which that pyramid is attached, and one of said triangular sides lying in the same plane as the top wall of the main body portion, a pair of accessory components shaped as whale flippers attached to respective opposite side walls of the main body portion near one end wall, and an accessory component shaped as the tail of a whale attached to the apex of the pyramid attached to the other end wall of the main body portion, said main body portion and accessory components simulating a whale.

* * * * *